United States Patent [19]

Givler

[11] Patent Number: 4,823,105

[45] Date of Patent: Apr. 18, 1989

[54] METHOD OF FORMING A THERMOSTATIC SWITCH WITH A NARROW OPERATING TEMPERATURE RANGE

[75] Inventor: Omar Givler, North Canton, Ohio

[73] Assignee: Portage Electric Products, Inc., North Canton, Ohio

[21] Appl. No.: 228,102

[22] Filed: Aug. 4, 1988

[51] Int. Cl.[4] ..... H01H 37/12; H01H 37/54

[52] U.S. Cl. ..... 337/368; 374/1; 337/365

[58] Field of Search ..... 337/368, 365, 347, 57; 374/1; 29/622

[56] References Cited

U.S. PATENT DOCUMENTS 2,627,003 1/1953 Porter ..... 374/1

2,820,870 1/1958 Moksu ..... 337/368

*Primary Examiner*—H. Broome

*Attorney, Agent, or Firm*—McAulay, Fields, Fisher, Goldstein & Nissen

[57] ABSTRACT

The present invention provides a method of forming a thermostatic switch having a calibrated operating temperature range that is defined by a calibrated actuation temperature and a calibrated reset temperature. In accordance with this method a snap action thermostatic switch is provided having a bimetal blade with a snap acting depression. The blade is formed to have a range of actuation temperatures above the desired actuation temperature and a range of reset temperatures below the desired reset temperature. The actuation temperature is calibrated in a heated temperature environment that has an initial temperature that is equal to the desired actuation temperature by a fulcrum-like calibration projection. The reset temperature is then calibrated in the heated temperature environment, after the temperature has been lowered to equal the desired reset temperature. In a preferred embodiment, this is accomplished by bending a terminal strip mounting the bimetal blade, towards a fixed contact of the switch while the blade is in a deformed state.

5 Claims, 1 Drawing Sheet

METHOD OF FORMING A THERMOSTATIC SWITCH WITH A NARROW OPERATING TEMPERATURE RANGE

FIELD OF THE INVENTION

The present invention relates to a thermostatic switch that utilizes a snap acting bimetal blade that, at an actuation temperature deforms and that, at a reset temperature, returns to an undeformed state to alternately establish circuit open and circuit closed conditions of the switch. Even more particularly the present invention relates to a method of forming a thermostatic switch having a calibrated operating temperature range in which the differential between the actuation and the reset temperatures is narrow.

BACKGROUND OF THE INVENTION

Snap acting thermostatic switches have long been used to protect motors, generators, transformers and like electrical components by breaking contact between the component and a power supply during an elevated transient temperature of the ambient and by re-establishing contact between the component and the power supply when the ambient temperature has cooled to a safe level. Contact is made and broken within the switch by a fixed contact and a movable contact connected to one end of a temperature responsive, snap action, bimetal blade. The blade is mounted in the switch so as to be cantilevered from its other end. There are of course many different switch designs in the prior art. For exemplary purposes, the fixed contact and the bimetal blade can be mounted on a pair of terminal strips that are mounted in a non-conducting case with the strips insulated from one another. As another example, the blade can be mounted on a basewall of an electrically conductive can and the fixed contact can be mounted on an electrically conductive lid that is insulated from the can. As still another example the switch can have an elongated terminal arm and a terminal lug mounted in the open end of a case in an insulated manner from one another. In such a switch the bimetal blade is cantilevered from the terminal lug and the fixed contact is connected to an end of the terminal arm that projects into the case.

The snap action of the bimetal blade is produced by a centrally located, cupped or dish-like portion which can be referred to as a snap acting depression. When the ambient temperature reaches an actuation temperature, a sudden reversal of the shape of the depression occurs to produce a deformed state of the bimetal blade. In the deformed state of the bimetal blade, the movable contact is spaced a distance from the fixed contact and the end of the blade, mounting the movable contact, is located against some point of contact or step on the switch. Depending upon the switch design, the step can be the terminal strip mounting the bimetal blade, a wall of the case adjacent to the terminal lug that in turn mounts the bimetal blade, or the basewall of the electrically conductive can mounting the bimetal blade. In any of the switch designs, the spacing of the contacts produces a circuit open condition of the switch in which contact between a power supply and an electrical component is broken. After a sufficient time has elapsed, and the ambient has cooled sufficiently to reach a reset temperature, the snap acting depression reverses to return the bimetal blade to an undeformed state to produce a circuit closed condition of the switch. In the circuit closed condition, the movable contact is located against the fixed contact and contact is re-established between the power supply and the electrical component.

For a variety of reasons, that are well known in the art, a particular bimetal blade design can only be specified as having a range of actuation temperatures and a range of reset temperatures. In order to insure the protection of the electrical component from elevated ambient temperatures, often, the actuation temperature is calibrated to an exact figure within the range of actuation temperatures. The calibration is performed on the switch in a heated temperature environment in which the ambient temperature is the desired actuation temperature. The blade is then prestressed by adjustment of a well known fulcrum-like calibration projection that is formed on the elongated member of the switch. The calibration projection bears against the snap acting depression, when the bimetal blade is in its undeformed state, with a sufficient force to cause the depression to suddenly reverse its shape or snap. Even though, when calibrated, such a switch can protect the component from elevated ambient temperatures, the operating temperature differential of the switch, between the actuation and the reset temperatures, can be far too broad relative to the safe operating of the component. This is because the reset temperature is not calibrated and as such, the reset temperature of the switch can be much lower than the safe operating temperature of the component. As can be appreciated, the disadvantage of this is that, although the ambient temperature can be at a safe level, the component remains idle until the ambient has cooled to the unnecesarily low reset temperature.

The present invention provides a method of forming a thermostatic switch with a calibrated operating temperature range in which both the actuation and reset temperatures are calibrated. The operating temperature range can therefore be selected to more realistically protect the electrical component, than prior art switches, by producing a calibrated operating temperature range that can be the desired, preferred operating temperature range of the electrical component. As will be discussed in greater detail hereinafter, this is accomplished by providing a blade that has an actuation temperature range that is above the desired actuation temperature and that has a reset temperature range below the desired reset temperature. The blade is then prestressed, as described above, to calibrate the actuation temperature. However, unlike the prior art, the calibrated actuation temperature is below the supplied range of actuation temperatures for the particular blade. After calibration of the actuation temperature, the blade is also prestressed, when in its deformed state, to upwardly calibrate the reset temperature, above the supplied range of reset temperatures, and towards the actuation temperature.

A switch formed in the manner described above can have a very narrow operating temperature differential to function with a component having a narrow operating temperature range requirement. It should be pointed out here that the prior art has provided thermostatic switches with small operating temperature differentials. These switches however, have shallow snap acting depressions of between about 0.0254 mm. and about 0.0408 mm. deep, and function more on a creep action of the contacts than a snap action at the limits of a calibrated operating temperature range. Thus, while such prior art switches have a small operating temperature differential, they do not have the exactly calibrated, narrow temperature range of a switch formed in accordance with the present invention.

SUMMARY OF THE INVENTION

As stated above, the present invention provides a method for forming a thermostatic switch with a calibrated, narrow operating temperature range. The calibrated operating temperature range is defined by a calibrated actuation temperature and a calibrated reset temperature. The method includes providing a thermostatic switch having a fixed contact, a bimetal blade, and a movable contact connected to one end of the bimetal blade. The bimetal blade has a snap acting depression located between the ends of the bimetal blade. The blade has a range of actuation temperatures, at which the snap acting depression snaps to produce a deformed state of the blade, and a range of reset temperatures at which the snap acting depression snaps back to produce an initial undeformed state of the blade. In accordance with the method of the present invention, the blade is formed so that the supplied actuation temperature range is above the calibrated actuation temperature and the supplied reset temperature range is below the calibrated reset temperature. The switch also includes means, having an elongated member and a contact point connected to the member, for mounting the fixed contact so as to be spaced from the member in the circuit open condition, facing towards the contact point, and for mounting the bimetal blade in a cantilevered manner from the other of its ends.

An ambient temperature environment is provided for the switch that initially has a temperature that is equal to the desired calibrated actuation temperature. In this environment, the blade is in an undeformed state and the movable contact is located against the fixed contact. A fulcrum-like calibration projection, provided in the member, forcibly bears against the snap acting depression and thereby prestresses the blade to an extent that the snap acting depression snaps to produce the deformed state of the blade. In the deformed state of the blade, the movable contact is spaced a distance from the fixed contact and the other side of the blade is located against a step associated with the elongated member. The ambient temperature is then lowered to be equal to the desired calibrated reset temperature. Thereafter, the step is moved towards the fixed contact to a fixed position in which the blade is prestressed to an extent that the snap action depression snaps back towards the conductive member. Since both the actuation and reset temperatures of the operating temperature range are exactly calibrated, a narrow calibrated operating temperature range can be produced which can be the desired range of operating temperatures of the electrical component that the switch is designed to protect. Means are provided such that, when the step is repositioned, the fulcrum-like member remains, essentially, stationary.

DESCRIPTION OF THE DRAWINGS

In the accompanying drawings

DETAILED DESCRIPTION OF THE INVENTION

Figure 1:
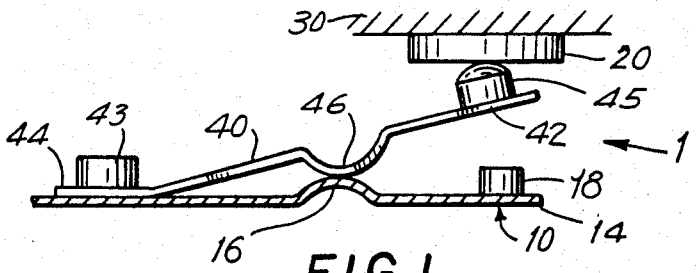
FIG. 1 is a schematic, elevational view of a thermostatic switch in the circuit closed condition.
Figure 2:
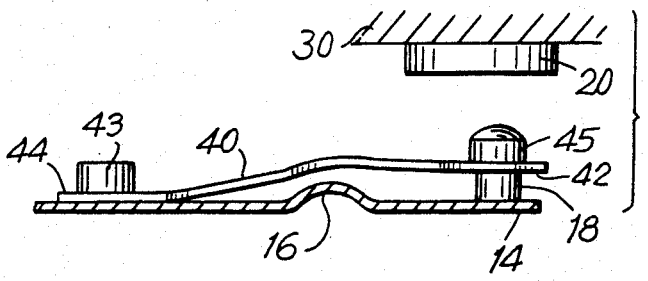
FIG. 2 is a schematic, elevational view of a thermostatic switch in a circuit open condition.

FIG. 1 is a schematic illustration of a thermostatic switch 1. Switch 1 can have an elongated, electrically conductive terminal strip 10, a fixed contact 20, a bimetal blade 40 and a movable contact 45. A portion of the switch, illustrated by 30, is provided for mounting the fixed contact 20 so as to be spaced from and to face towards the terminal strip 10. The bimetal blade 40 can be connected, at one end 42, to the movable contact 45 and connected, at the other end 44, to the terminal strip 10, in a cantilevered manner, by means of a weld button 43. As illustrated, the other end 42 of the bimetal blade freely extends along a side of the terminal strip 10 facing towards the fixed contact 20. The movable contact 45 faces towards the fixed contact 20. The bimetal blade also has a well known dish-like or cupped portion to form a snap acting depression 46 located between the ends 42 and 44. It is important to point out here that the depression 46 should be between about 0.100 mm. and about 0.130 mm. deep for a switch formed in accordance with the present invention to properly function with a snap action. FIG. 1 illustrates the bimetal blade 40 in its initial, undeformed state in which the movable contact 45 is located against the fixed contact 20 to form a circuit closed condition of the switch 1. A well known fulcrum-like calibration projection 16 can be formed in the terminal strip 10 that bears against the snap acting depression 46 of the bimetal blade 40 when in its undeformed state. With reference now also to FIG. 2, a circuit open condition of the thermostatic switch is illustrated in which the snap acting depression 46 has snapped towards the fixed contact 20 to produce a deformed state of the bimetal blade 40 in which the movable contact is spaced from the fixed contact 20 and the other end 42 of the blade is located against a contact point connected to the terminal strip 10. The contact point can be a limit stop projection 18 located at end 14 of the terminal strip 10. Projection 18 functions in a manner well known in the art to prevent welding of the blade 40 to terminal strip 10 by electrical arcing between the contacts. Projection 18 is optional, however, and the contact point could simply be the surface of terminal strip 10 opposite to the fixed contact 20.

Bimetal blades, such as illustrated by blade 40, are normally manufactured by pressing, under great pressure, two metals having different coefficients of expansion. The snap acting depression, such as illustrated by 46 is formed in a subsequent manufacturing step. Even though care is taken in the manufacture of bimetal blades to produce uniform operating characteristics for a particular blade design, there exist subtle differences in the structure of any two blades of a particular design. As a result, as stated previously, only a range of actuation temperatures, in which the snap acting depression 46 snaps towards the fixed contact 20 to produce the deformed state of the blade 40 and only a range of reset temperatures, in which the snap acting depression 46 snaps back towards the terminal strip 10 to return the blade to its undeformed state, can be specified for a particular blade design. The blade selected for the method of the present invention should have a range of actuation temperatures, specified for the particular blade, that is above the desired calibrated actuation temperature. Additionally, the blade should have a range of reset temperatures, specified for the particular blade, that is below the desired, calibrated reset temperature.

Figure 3:
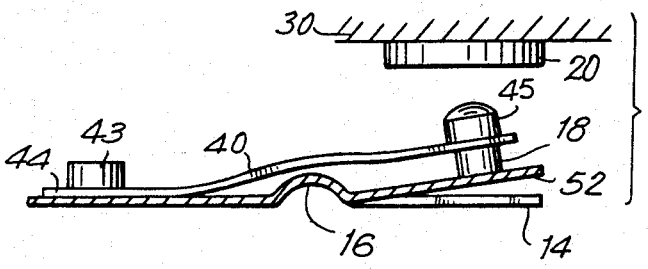
FIG. 3 is a schematic, elevational view of a thermostatic switch having a calibrated operating temperature differential formed in accordance with the method of the present invention.

In accordance with the present invention the fulcrum-like calibration projection 16, formed in the terminal strip 10, forcibly bears against the snap acting depression 46 when the bimetal blade 40 is in its deformed state with a sufficient force to prestress the bimetal blade 40. In accordance with the present invention, but unlike the prior art, the snap acting depression 46 is prestressed by projection 16 to an extent that the calibrated actuation temperature of the blade 40 is lowered below the range of actuation temperatures for a particular design of the bimetal blade 40. This is accomplished by heating the switch 1 in an ambient temperature environment, known well in the art, that has an initial temperature that is equal to the desired actuation temperature. The projection 16 is then formed to bear against the snap acting depression 46 to cause depression 46 to snap towards the fixed contact 20. With reference to FIG. 3, after the actuation temperature is exactly calibrated, as described above, the present invention also contemplates calibrating the reset temperature. This is accomplished by lowering the temperature of the ambient temperature environment to a temperature that is equal to the desired reset temperature; and, thereafter, moving the contact point (projection 18 of the preferred embodiment) towards the fixed contact 20 to a fixed position in which the depression 46 snaps towards the terminal strip 10. In the preferred embodiment this movement step is accomplished by simply bending the terminal 10 towards the fixed contact 20, while making certain that the projection 16 remains, essentially, stationary.

It is understood that the method of the present invention could have application to many different thermostatic switch designs. In this regard, it is only required that the switch design incorporate an elongated member. For instance, terminal strip 10 and switch portion 30 could be a pair of spaced terminal strips, insulated from one another and mounted in an electrically conductive case. In such an embodiment, terminal strip 10 would be the elongated member. Alternately, terminal 10 can be the basewall of an electrically conductive can and switch portion 30 could be a lid of the can. The elongated member would be the basewall of the can. In fact, this latter embodiment could be the switch design disclosed in U.S. Pat. No. 3,430,177, which is hereby incorporated by reference. Moreover, as stated previously, the switch portion 30 could be an elongated terminal arm, cantilevered from one end of a case and connected, at the other end, to the fixed contact 20. In such a switch, the blade 40 would also be cantilevered from a terminal lug mounted in the end of the case and insulated from the terminal arm. As can be appreciated, the elongated member of such a switch would be a wall of the case and as such, the bimetal blade 40 would not be connected directly to the elongated member. In any embodiment, the calibration projection 16 could be formed, in a manner known well in the art, by dimpling the elongated member at a location adjacent to the snap action depression 46. In the embodiment disclosed in U.S. Pat. No. 3,430,177, the bending step could be accomplished by deforming the can at a location near the limit stop projection, such as illustrated herein by projection 18. As would occur to one skilled in the art, other possible means of prestressing are possible.

Figure 4:
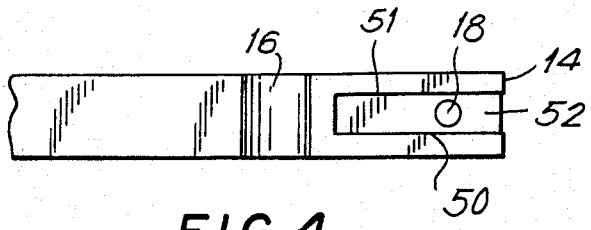
FIG. 4 is a schematic, plan view of an embodiment of an elongated terminal strip used in accordance with the present invention.

One means to assure that projection 16 remains essentially stationary when end 14 is bent toward stationary contact 20 is illustrated in FIG. 4. In this embodiment, the end 14 is lanced along the lines 50, 51 to form a tongue 52 which mounts projection 18. In calibrating the reset temperature, only the tongue 52 is bent upwardly, thus leaving projection 16, essentially, in its original position. Further, and without lancing, end 42 could, initially, be located in a portion higher than illustrated, so that very little movement would be needed to calibrate the reset temperature, again leaving projection 16, essentially in its original position.

Thermostatic switches can be formed in accordance with the method of the present invention to have an operating temperature differential of between about 25° C. and about 50° C. Experimentally, a switch has been formed having an operating temperature differential as narrow as 10° C. Additionally, it is possible to form a switch having an operating temperature range slightly above room temperature. In such an application, the bimetal blade should be formed with a possible range of reset temperatures that are below room temperature so that the reset temperature can be upwardly calibrated above room temperature. By way of an example, a thermostatic switch can be formed in accordance with the preferred embodiment of the present invention that is designed to operate at between about 125° C. and about 150° C. In accordance with the present invention a bimetal blade 40 is provided with an actuation temperature range of between about 155° C. and about 190° C. and a reset temperature range of between about 60° C. and about 90° C. A fulcrum-like calibration projection, such as 16, is formed in the terminal strip 10 as described above, to reduce and calibrate the actuation temperature to about 150° C. Thereafter, in accordance with FIG. 3 and the above description, the terminal 10 is bent to raise and calibrate the reset temperature to about 125° C. As can be seen, the reset temperature of the switch 1 approaches the actuation temperature and the operating temperature differential is only 25° C. As also can be seen, the maximum operating temperature differential of such a switch that could be expected without a formation of the switch in accordance with the present invention, would be about 65° C. As another example, a thermostatic switch can be formed to operate with an actuation temperature of about 125° C. and a reset temperature of about 100° C. In such a switch, a bimetal blade 40 is selected that has a range of actuation temperatures between about 155° C. and about 190° C. and a range of reset temperatures of about 60° C. and about 80° C. An example of a switch that can be formed to have an operating temperature range slightly above room temperature is a switch having an actuation temperature of about 50° C. and a reset temperature of about 35° C. In this switch, a bimetal blade 40 is selected that has a range of actuating temperatures of between about 60° C. and about 90° C. and a range of reset temperatures of between about 15° C. and about 25° C.

While the present invention has been described by reference to an illustrated preferred embodiment, the invention should not be considered as so limited but only as limited as set forth in the appended claims.

I, claim;

1. A method of forming a thermostatic switch with a calibrated operating temperature range that is defined by a calibrated actuation temperature and a calibrated reset temperature, said method including:

providing a thermostatic switch having, a fixed contact, a bimetal blade having a snap acting depression located between the ends of said bimetal blade, a range of actuation temperatures at which said snap acting depression snaps to produce a deformed state of said blade and a range of reset temperatures at which said snap acting depression snaps back to return said blade to an initial undeformed state, said blade being formed so that said range of actuation temperatures is above said calibrated actuation temperature and said range of reset temperatures is below said calibrated reset temperature, a movable contact connected to one of said ends of said bimetal blade, and means, having an elongated member and a contact point connected to said member for mounting said fixed contact so that said fixed contact is spaced from said member and faces towards said contact point, and for mounting said bimetal blade in a cantilevered manner from the other of its said ends so that when said blade is in its said deformed state, said movable contact is spaced from said fixed contact and said other end of said blade is located against said contact point and when said blade is in its initial, undeformed state, said movable contact is located against said fixed contact;

providing an ambient temperature environment for said switch that is initially equal to said calibrated actuation temperature;

providing a fulcrum-like calibration projection in said member to forcibly bear against said snap acting depression and to thereby prestress said blade to an extent that said snap action depression snaps to produce said deformed state of said blade;

decreasing said ambient temperature environment to be equal to said reset temperature; and moving said contact point towards said fixed contact to a fixed position in which said blade is prestressed to an extent that said snap acting depression snaps back to produce said initial undeformed state of said blade.

2. The method of claim 1 wherein said contact point is moved by bending said elongated member towards said fixed contact.

3. The method of claim 2 wherein said fulcrum-like projection is a calibration dimple formed in said elongated member.

4. The method of claim 1 wherein said fulcrum-like projection is a calibration dimple formed in said elongated member.

5. The method of claim 2 where only a lanced portion of said elongated member is bent toward said fixed contact.

* * * * *